US011438715B2

(12) United States Patent
Robertson

(10) Patent No.: US 11,438,715 B2
(45) Date of Patent: Sep. 6, 2022

(54) HEARING AIDS WITH FREQUENCY CONTROLS

(71) Applicant: Marley C. Robertson, Stephens City, VA (US)

(72) Inventor: Marley C. Robertson, Stephens City, VA (US)

( * ) Notice: Subject to any disclaimer, the term of this patent is extended or adjusted under 35 U.S.C. 154(b) by 126 days.

(21) Appl. No.: 17/029,754

(22) Filed: Sep. 23, 2020

(65) Prior Publication Data

US 2022/0095062 A1 Mar. 24, 2022

(51) Int. Cl.
*H04R 25/00* (2006.01)

(52) U.S. Cl.
CPC ..... *H04R 25/558* (2013.01); *H04R 25/554* (2013.01)

(58) Field of Classification Search
CPC ..... H04R 25/558; H04R 25/554
See application file for complete search history.

(56) References Cited

U.S. PATENT DOCUMENTS

| | | | | |
|---|---|---|---|---|
| 8,675,900 | B2 * | 3/2014 | Anderson | A61B 5/121 381/314 |
| 10,390,155 | B2 * | 8/2019 | Simonides | H04R 25/70 |
| 2015/0195641 | A1 * | 7/2015 | Di Censo | H04R 1/1083 381/71.6 |

FOREIGN PATENT DOCUMENTS

WO WO-2020214956 A1 * 10/2020

* cited by examiner

*Primary Examiner* — Brian Ensey

(74) *Attorney, Agent, or Firm* — Miller Law Group, PLLC

(57) ABSTRACT

An operating system is provided for a hearing aid through which the hearing aid can be controlled to enhance the operation of the hearing aid. The operating system can be associated with a Smart Phone that connects with the hearing aid through Bluetooth technology. The control system can enhance desired frequencies of sound, corresponding to selections made by the individual wearing the hearing aid to better hear certain desired sounds. The control system can simply amplify sounds falling into the selected frequency ranges to distinguish those desired sounds above sounds falling into other frequencies. Optionally, the control system could at least partially block, filter or cancel the sounds falling outside the selected frequency ranges to further distinguish the sounds of the selected frequency over the sounds of the non-selected frequencies. The control system can be used to control undesirable sounds for people with ASD or TBI.

16 Claims, 3 Drawing Sheets

HEARING AIDS WITH FREQUENCY CONTROLS

FIELD OF THE INVENTION

The present invention relates generally to hearing aids that augment hearing in individuals having auditory disabilities and, more particularly, to a hearing aid that is controlled through association with a computer to enhance sounds in a desired frequency.

BACKGROUND OF THE INVENTION

Hearing aids are utilized by millions of people to enhance their ability to hear sounds, which ability has been diminished through age, disease or injury. Essentially, hearing aids amplify the sounds encountered by an individual and transmit those amplified sounds into the individual's ear canal to increase the individual's ability to hear those sounds. Hearing aids, however, do not enhance certain desired frequencies of sounds to specifically enable the individual to hear certain desired types of sounds.

Hearing aids can incorporate Bluetooth technology and receive sounds from a remote source that are transmitted through the technology directly to the hearing aid worn by the individual. Such technology enables the individual to hear broadcast sounds, such as a television program, or music from a device broadcasting that music. A Smart Phone can transmit sounds encountered by the Smart Phone receiver, including a phone call, or simply ambient sounds, to the hearing aids so that the individual is hearing directly from the Smart Phone or other similar device.

Today's cell phones, e.g. Smart Phones, have tremendous computing power, and substantial amounts of memory available for use. Application programs have been developed to harness that computing power and memory capabilities to do many complex and helpful tasks. Application programs have been developed for operating hearing aids from Smart Phones, including turning them on and off, amplification volume, etc.

It would thus be desirable to provide a control system for hearing aids that would specifically control the frequency range desired by the individual wearing the hearing aids to enable the individual to better hear the sounds that are desired.

SUMMARY OF THE INVENTION

It is an object of this invention to overcome the disadvantages of the prior art by providing a frequency control for hearing aids.

It is another object of this invention to provide a hearing aid system that can be associated with a functioning computer to control the sounds encountered by the individual wearing the hearing aids.

It is an advantage of this invention that the hearing aids will operate to do more than simply amplify sound.

It is a feature of this invention that certain frequencies of sound can be selected by the individual to be amplified would transmission to the ear canal of the individual wearing the hearing aids.

It is another feature of this invention that the hearing aids can be operated to simply amplify all sound at the selection of the individual wearing the hearing aids.

It is still another feature of this invention that the computer processor can amplify selected frequency ranges of sound.

It is another advantage of this invention that the amplification of selected frequency ranges will enhance the individual's ability to hear the sounds falling in the selected frequency ranges.

It is a further feature of this invention that the selected frequency ranges are enhanced by blocking, filtering or canceling the frequency ranges that are outside the selected frequency ranges.

It is still another advantage of this invention that the blocking, filtering or canceling of non-selected frequency ranges will enable the individual's ability to hear the sounds falling in the selected frequency ranges.

It is still a further feature of this invention that background noises can be de-emphasized in the transmission of sounds into the individual's ear canal, thus enabling the desired sounds to be heard more clearly by the individual.

It is another feature of this invention that the sounds encountered by an individual can be classified according to decibel volume.

It is yet another advantage of this invention that the selection of sounds to be enhanced for the individual wearing a hearing aid can be based on the relative decibel volume of the sounds by frequency range.

It is still another feature of this invention that hearing aids coupled with the control system can be used to assist people with Autism Spectrum Disorder (ASD) to control undesirable sounds from entering his/her ear canals and allow limit offending sensory stimuli.

It is yet another feature of this invention that the control system can be utilized to track sound sensitivities and to slowly introduce offending sounds to the user in order to decrease the sensitivity for the user over time.

These and other objects, features and advantages are accomplished according to the instant invention by providing an operating system for a hearing aid through which the hearing aid can be controlled to enhance the operation of the hearing aid. The operating system can be associated with a Smart Phone that connects with the hearing aid through Bluetooth technology. The control system can enhance desired frequencies of sound, corresponding to selections made by the individual wearing the hearing aid to better hear certain desired sounds. The control system can simply amplify sounds falling into the selected frequency ranges to distinguish those desired sounds above sounds falling into other frequencies. Optionally, the control system could at least partially block, filter or cancel the sounds falling outside the selected frequency ranges to further distinguish the sounds of the selected frequency over the sounds of the non-selected frequencies. Alternatively, the control system could have the hearing aid operate in a non-enhanced mode of operation to amplify all sounds. The control system can be used to control undesirable sounds for people with ASD.

It is yet another feature of this invention that the control system can be utilized to completely block or diminish loud sounds, for example, sounds that have the same frequency of gun shots or explosive devices which might trigger military veterans to have Post-Traumatic Stress Disorder (PTSD) symptoms.

BRIEF DESCRIPTION OF THE DRAWINGS

The foregoing and other objects, features, and advantages of the invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

DETAILED DESCRIPTION OF THE PREFERRED EMBODIMENT

Figure 1:
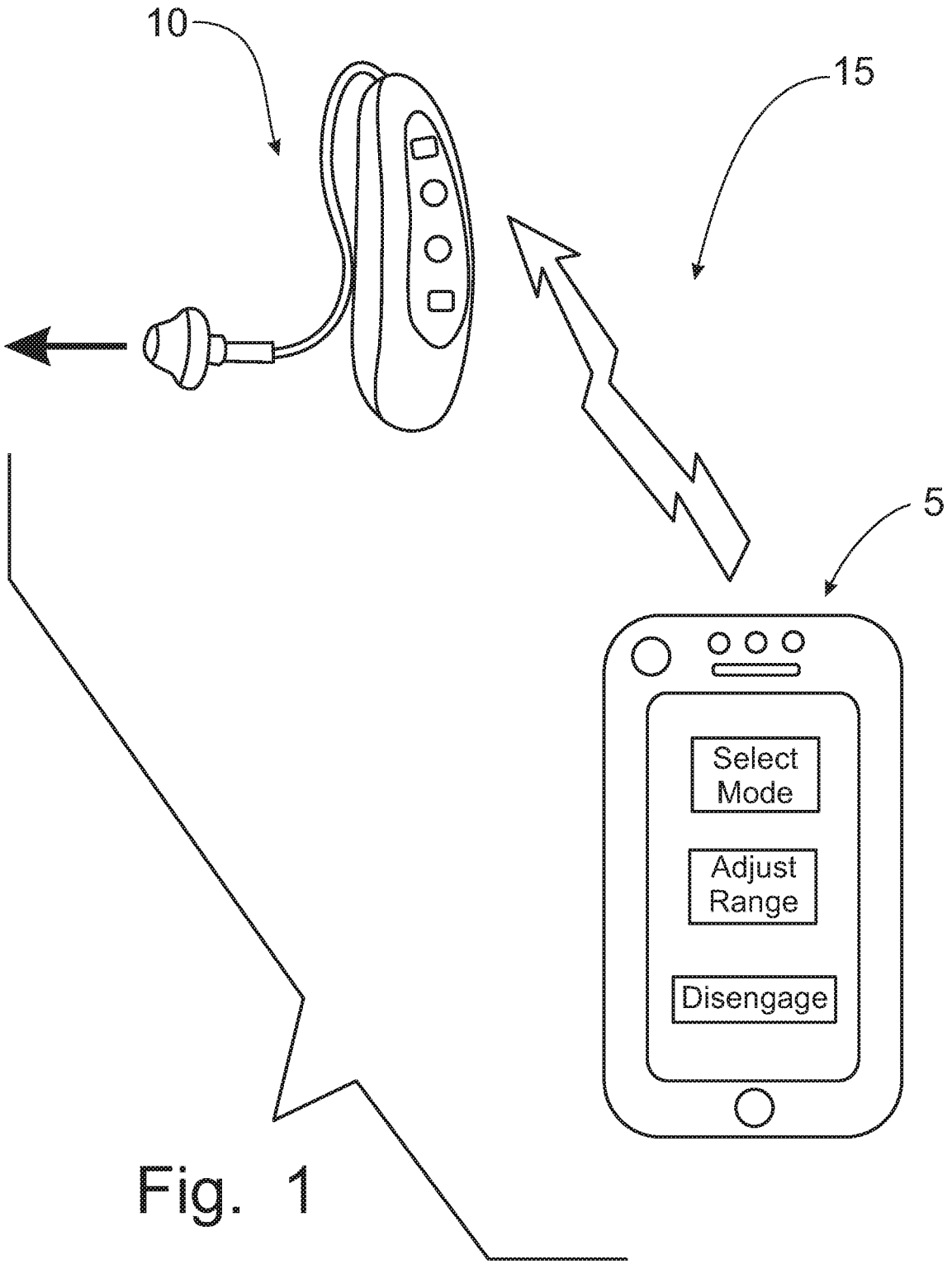
FIG. 1 is a schematic diagram of the control system incorporating the principles of the instant invention.
Figure 2:
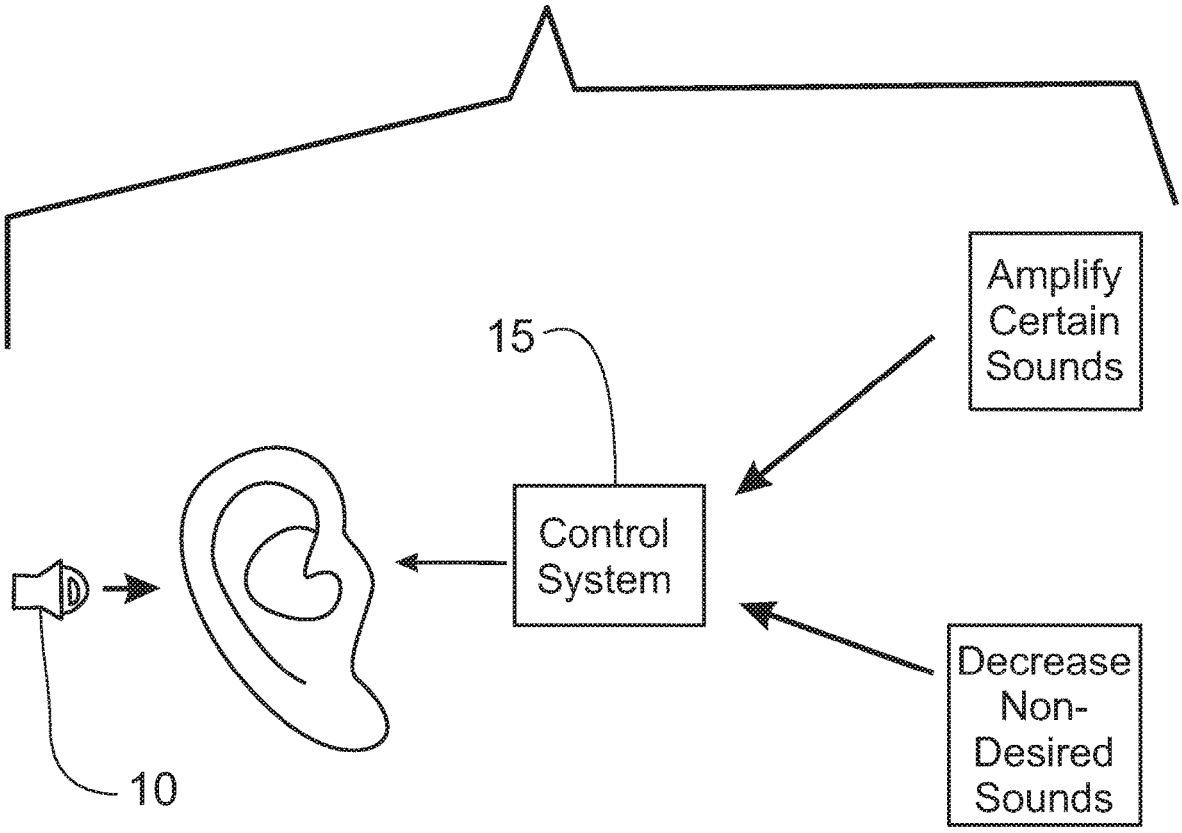
FIG. 2 is a schematic diagram depicting one aspect of the control system for hearing aid operation.
Figure 3:
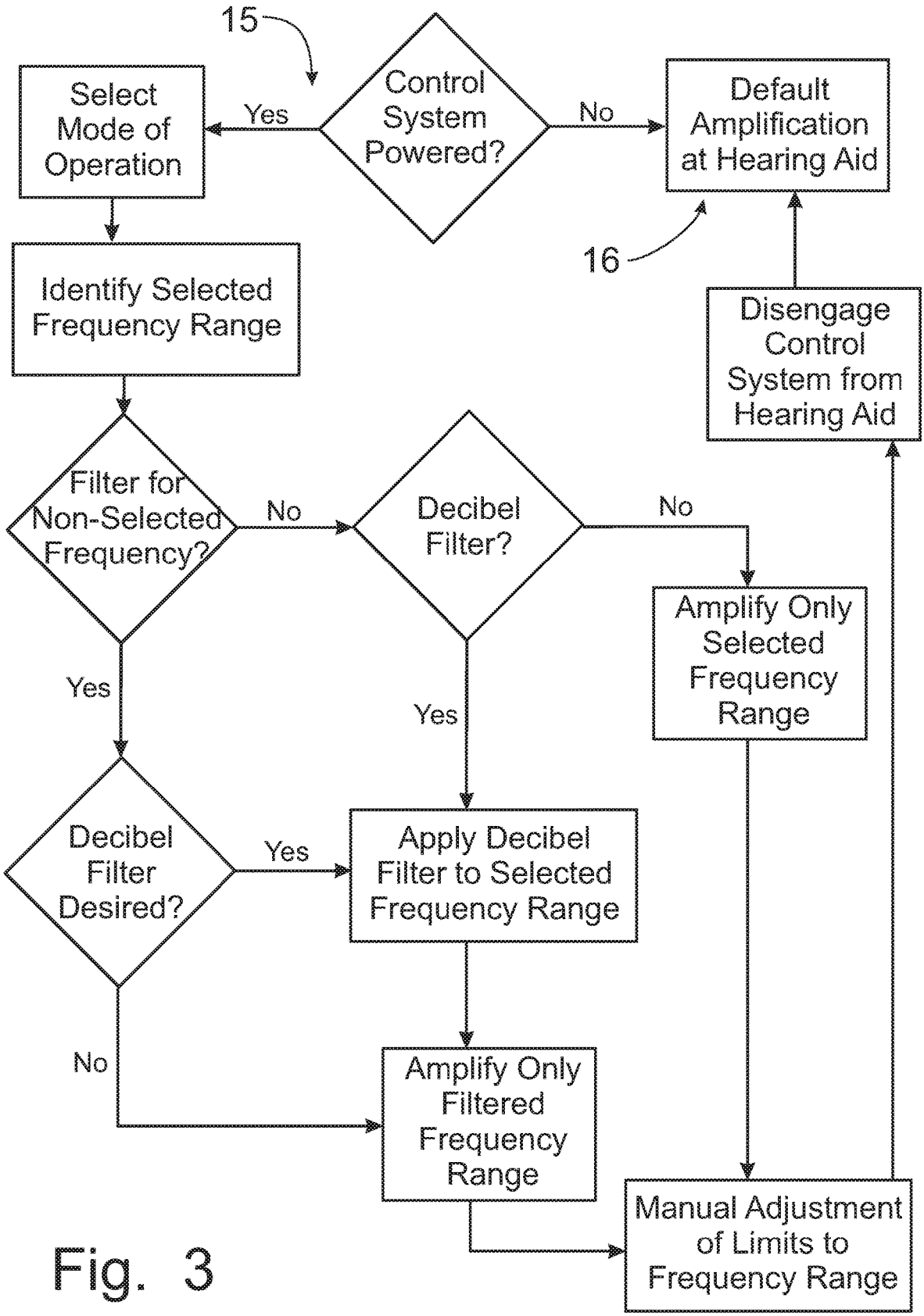
FIG. 3 is a logic flow diagram for the control system incorporating the principles of the instant invention.

Referring to the drawings, a control system for a hearing aid that enhances the hearing of an individual wearing the hearing aid can best be seen. The hearing aid 10 is operably connected to a control system 15 that is preferably associated with an operating computer 5, such as a Smart Phone or a Smart Watch, that will run an application program loaded onto the computer processor 5. Preferably, the control system 15 can communicate with the hearing aid 10 through Bluetooth technology or similar transmission technology.

The control system 15 can be selectively manipulated by the individual wearing the hearing aid 10 to select preprogrammed functions, or to provide a customized function. As to preprogrammed functions, the control system 15 provides a function 16 that instructs the hearing aid 10 to amplify all sounds encountered by the hearing aid 10, or in other words, to operate as a standard hearing aid 10 without enhancing any selected frequency ranges. In this standard mode of operation 16, the hearing aid 10 can operate without association with the control system 15. Alternatively, the control system 10 can use the microphone function of the Smart Phone 5 to receive all sounds irrespective of frequency and transmit the sounds to the hearing aid 10 for transmission into the individual's ear canal, as is known in the art. This standard mode of operation 16 is preferably the default mode of operation in that the hearing aid can still function as a conventional hearing aid without association with the control system 15.

Preferably, the control system 15 will provide several preprogrammed functions or modes of operation in addition to the standard mode of operation 16. For example, a preferred preprogrammed mode of operation is to hear the human voice better. The male human voice is typically between 70 Hz and 150 Hz, while the female human voice is usually an octave higher and is typically between 140 Hz and 220 Hz. Therefore, to preprogram a mode of operation to hear conversations better, the frequencies of 70-220 Hz can be enhanced to the exclusion of all other frequencies to help the individual wearing the hearing aid hear human voices better than background sound. Another preprogrammed mode of operation could be music, the mid range of which runs from about 250 Hz to about 7000 Hz. Another example could be a mode of operation for hearing birds singing, which typically fall between 1000 Hz and 8000 Hz.

To enhance the hearing of the selected sounds, the control system 15 can be activated to use one of the preprogrammed modes of operation. The selected frequency range can be amplified to the exclusion of the other non-selected frequencies. In addition to, or as an alternative to, the amplification of the selected frequency ranges, the non-selected frequency ranges can be at least partially filtered or canceled to prevent the interference of the non-selected frequency sounds from interfering with the amplified selected sound frequencies. In addition, the control system can also apply a volume filter to the non-selected frequency sounds. For example, the low murmuring of people talking in a restaurant can fall within the selected frequencies for human voices to be enhanced, but not enhanced by the control system 15 because the background noise does not reach a decibel threshold.

The control system 15 can also provide customized modes of operation in which certain frequency ranges can be specified, or the manner of enhancement can be selected, whether filtering or cancellation is desired, or what the decibel threshold should be for background noise. Once the mode of operation is selected, the control system 15 through the Smart Phone can make adjustments as to any of the parameters related to the mode of operation. For example, if a conversation mode of operation is selected, and the predetermined frequency range to be amplified is 100 Hz to 220 Hz but the individual utilizing the hearing aids encounters a person with a deep voice that is below the predetermined frequency range, the individual can access the control system 15 through the Smart Phone application program and make an appropriate adjustment to the lower limit of the frequency range being amplified.

In the example stated in the previous paragraph, the conversation mode of operation can have other preset parameters, such as lowering the amplification of the sounds outside of the predetermined frequency range, as opposed to canceling such sounds, which would enable the individual wearing the hearing aids to determine that he/she is not hearing the individual with the deep voice adequately and signaling the individual to change the frequency parameters, as noted above. In addition, the preset parameters of the conversation mode of operation could have a decibel threshold for sounds within the frequency range that would prevent background noises, such as distant human conversations, from being amplified, even though the conversations were in the predetermined frequency range. Other modes of operation for the control system 15 are operated similarly.

For human conversations where the individual utilizing the hearing aids normally has difficulty in distinguishing conversations because of ambient background noises, whether distant human conversations, such as in a restaurant, or other ambient background noises, such as highway noises, hearing aids associated with a control system incorporating the instant invention can be a great benefit to hearing the conversations around the individual. When in a highway mode of operation in which the ambient highway noises are being filtered and/or subjected to reduced amplification, as well as with other modes of operation, the application program will be alert for the reception of sirens and other known noises of emergency and police vehicles, so that those emergency noises are always amplified so that the individual utilizing the hearing aids can take notice of the emergency sounds and act accordingly.

When the Smart Phone is receiving sounds and transmitting those sounds to the hearing aid for transmission into the ear canal of the individual using the hearing aids, the receiver in the hearing aid is preferably bypassed and rendered inoperable so that the individual is hearing sounds solely through the Smart Phone. When the Smart Phone is turned off, or the application program is disengaged, the hearing aids revert to the normal function of amplifying all sounds for transmission into the ear canal of the individual.

In addition, the control system 15 can distinguish the left hearing aid from the right hearing aid because the hearing loss in the individual using the hearing aids may not be the same in both ears. Thus, distinguishing the performance of the left and right hearing aids through the control system will provide an opportunity for greater efficiencies. The control system 15 can also be gradable in that individuals can use this technology to overcome certain sound-based disabilities. As an example, some individuals who sustain Traumatic Brain Injuries (TBI) have difficulties going into crowds or loud stores. This can make it difficult on both the individual and his/her family. In such instances, limiting and controlling the sound would limit one of the sensory stimuli and would hopefully allow the individual with TBI to be able to tolerate the store for a longer period of time.

By utilization of the computing capability of Smart Phone technology, the control system 15 can be used also to track sound sensitivities in people and to determine if the sound sensitivity can decrease over time. The control system 15 can then be used to track this information in order to pinpoint the sound sensitivity and then determine what sort of background noise needs to be decreased, and whether people can improve his/her life functions and abilities. Accordingly, this control system 15 will be able to assist an individual to begin a desensitizing process in order to help the user in being able to slowly work in sounds that are not desirable. Slowly exposing the user to undesirable sounds may enable the slow exposure to increase the ability of the user to hear and to tolerate undesirable sounds.

In summary, the operation of the hearing aids in transmitting amplified sounds to the individual wearing the hearing aids can be selectively operated to amplify only certain frequencies of sounds as desired by the individual wearing the hearing aids. Filters to non-selected frequencies or to decibel volume of non-desired sounds can be used to eliminate the non-desired sounds from the sounds being amplified to the individual wearing the hearing aids, or to provide a lower amount of amplification so that the desired sounds can be emphasized to the individual to enhance his hearing capabilities.

The invention of this application has been described above both generically and with regard to specific embodiments. Although the invention has been set forth in what is believed to be the preferred embodiments, a wide variety of alternatives known to those of skill in the art can be selected within the generic disclosure. For example, the control system incorporating the principles of the instant invention is intended for loading onto a computer system, specifically the computer processor incorporated into conventional Smart Phones and similar technologies; however, as computer technology improves and can be miniaturized to fit into the case of a hearing aid, the control system can then be built into the hearing aid, with perhaps a remote control for setting the parameters and modes of operations for the control system.

For example, the computer processor 5 can be in the form of a laptop computer, a Smart Phone, a Smart Watch or other device incorporating a computer processor 5. The computer processor 5 can be incorporated into a separate and specifically functioning remote control device (not shown) that the user of the hearing aids 10 and control system 15 can carry on his or her person. One particular advantage of the Smart Watch and other personal devices is that changing the operative function of the control system 15, or the volume, or other operation of the hearing aid 10 is convenient and readily available to the user.

Having thus described the invention, what is claimed is:

1. A control system for operating a hearing aid from a computer having a processor and a memory, comprising:

a receiver operable to receive sounds;

a frequency selector to select a range of frequencies with respect to the sounds received by said receiver to define a specified range of frequencies;

a decibel filter operable to identify sounds within said selected range of frequencies but falling below a predetermined decibel threshold, the sounds identified by said decibel filter below said predetermined decibel threshold being diminished and the sounds within said range of frequencies above said predetermined decibel threshold being amplified; and an amplifier operable to amplify the sounds falling within said range of frequencies and falling above said predetermined decibel threshold so that said sounds falling within said range of frequencies and above said predetermined decibel threshold are emphasized into the hearing aid.

2. The control system of claim 1 further comprising:

a frequency filter to diminish sounds outside the specified range of frequencies to further emphasize the sounds falling within the specified range of frequencies.

3. The control system of claim 2 wherein said computer processor and memory are part of a cell phone, said cell phone communicating with said hearing aid through wireless transmission technologies.

4. The control system of claim 3 wherein said frequency filter eliminates sounds from outside the selected range of frequencies so that the eliminated sounds are not transmitted to the hearing aid.

5. The control system of claim 4 wherein separate frequency and/or decibel filters are provided for independent control of left and right hearing aids.

6. The control system of claim 3 wherein at least one predetermined mode of operation is provided in which at least one said selected range of frequencies is identified.

7. The control system of claim 6 wherein said control system can be manipulated to adjust the limits of said range of frequencies.

8. A control system for a hearing aid, comprising:

a computer processor with memory associated therewith on which the control system is loaded and operated, the control system being in communication with said hearing aid through wireless communication technology;

a frequency selector to select a range of frequencies of sounds for amplification and emphasis to said hearing aid;

a decibel filter operable to identify sounds within said selected range of frequencies above a predetermined decibel threshold, the sounds identified by said decibel filter below said predetermined decibel threshold being diminished to emphasize the sounds within said range of frequencies above said predetermined decibel threshold.

9. The control system of claim 8 further comprising:

a receiver operable to receive sounds, said frequency selector being operable with respect to the sounds received by said receiver to define a specified range of frequencies; and an amplifier operable to amplify the sounds falling within said range of frequencies so that said sounds falling within said range of frequencies are emphasized into the hearing aid.

10. The control system of claim 9 further comprising:

a frequency filter to diminish sounds outside the specified range of frequencies to further emphasize the sounds falling within the specified range of frequencies.

11. The control system of claim 10 wherein said computer processor and memory are associated with a cell phone.

12. A control system for a hearing aid loaded into a cell phone computer processor and memory to enhance sounds transmitted by said hearing aid, comprising:

a decibel filter operable to identify sounds received by said cell phone above a predetermined decibel threshold, the sounds identified by said decibel filter above said predetermined decibel threshold being amplified by said hearing aid to the exclusion of sounds falling below said predetermined decibel threshold.

13. The control system of claim 12 further comprising:

a frequency selector to select a range of frequencies of sounds for amplification and emphasis to said hearing aid;

a frequency filter to diminish sounds outside the specified range of frequencies to further emphasize the sounds falling within the specified range of frequencies.

14. The control system of claim 13 wherein said decibel filter is operable to identify sounds above said predetermined decibel threshold within said specified range of frequencies to be amplified by the hearing aid to the exclusion of sounds falling below said predetermined decibel threshold.

15. The control system of claim 14 a plurality of modes of operation are provided in which at least one said selected range of frequencies is identified, said control system being operable to permit manual adjustments to the limits of said at least one range of frequencies.

16. The control system of claim 15 wherein separate frequency and/or decibel filters are provided for independent control of left and right hearing aids.

* * * * *